US007588682B2

(12) United States Patent
Norman

(10) Patent No.: US 7,588,682 B2
(45) Date of Patent: Sep. 15, 2009

(54) PROCESS AND APPARATUS FOR ENHANCED RECOVERY OF OIL FROM OILY PARTICULATE MATERIAL

(76) Inventor: Kevin Norman, 28-57-6 West 4th, Elk Point, St. Paul, Alberta (CA) T0A 1A0

( * ) Notice: Subject to any disclaimer, the term of this patent is extended or adjusted under 35 U.S.C. 154(b) by 553 days.

(21) Appl. No.: 11/243,367

(22) Filed: Oct. 4, 2005

(65) Prior Publication Data

US 2007/0084801 A1 Apr. 19, 2007

(51) Int. Cl.
*C10G 1/04* (2006.01)

(52) U.S. Cl. ..... 208/391; 208/390

(58) Field of Classification Search ..... None
See application file for complete search history.

(56) References Cited

U.S. PATENT DOCUMENTS 4,288,232 A * 9/1981 Schmolka et al. ..... 44/281
4,783,268 A 11/1988 Leung
5,866,041 A * 2/1999 Svarz et al. ..... 516/11
6,074,549 A 6/2000 Bacon et al.
6,125,865 A 10/2000 Bacon et al.
6,527,960 B1 3/2003 Bacon et al.
6,555,009 B2 * 4/2003 Varadaraj ..... 210/708
6,776,234 B2 8/2004 Boudreau

FOREIGN PATENT DOCUMENTS

CA 2233710 8/2005

* cited by examiner

*Primary Examiner*—Tam M Nguyen
(74) *Attorney, Agent, or Firm*—Eckert Seamans Cherin & Mellott; Stephen A. Bucchianeri, Esq.

(57) ABSTRACT

An apparatus and process are described for processing oily particulate material. The process allows for recovery of the oil and separation of the water from the sand in the oily particulate material. The process involves transferring the oily particulate material into a vacuum tank and processing the oily particulate material in the vacuum tank. The apparatus is related to a vacuum tank for processing oily particulate material. The vacuum tank has a series of air supply pipes for adding compressed air to the material in the vacuum tank. Furthermore, the vacuum tank has air nozzles through which the air is added to the vacuum tank.

16 Claims, 6 Drawing Sheets

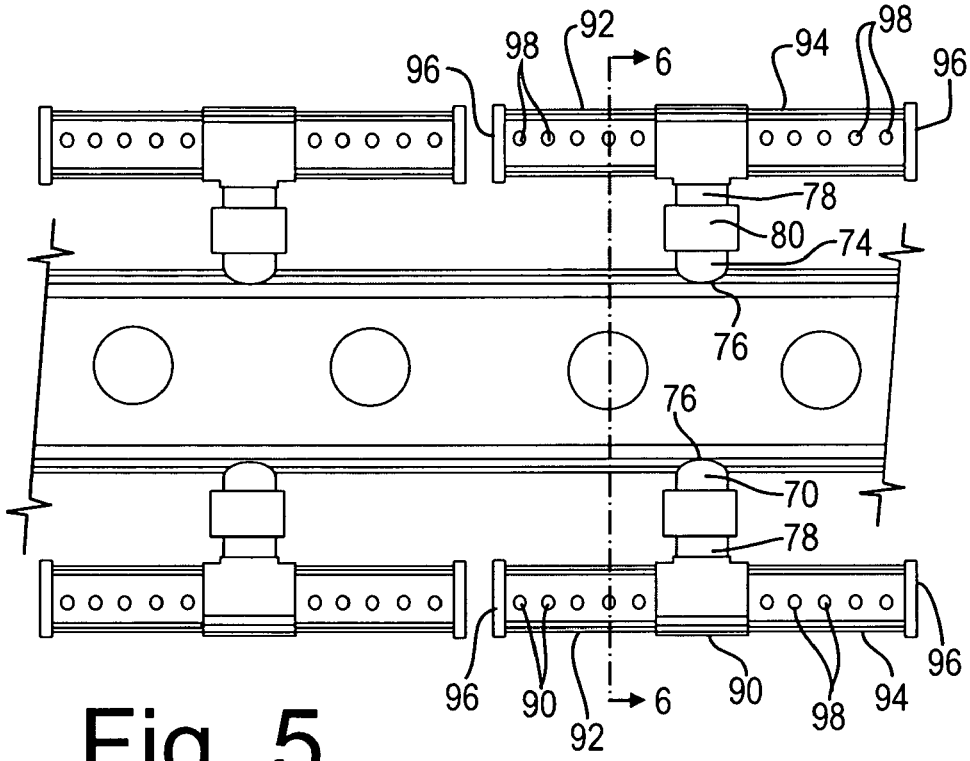
Fig. 5
Fig. 6
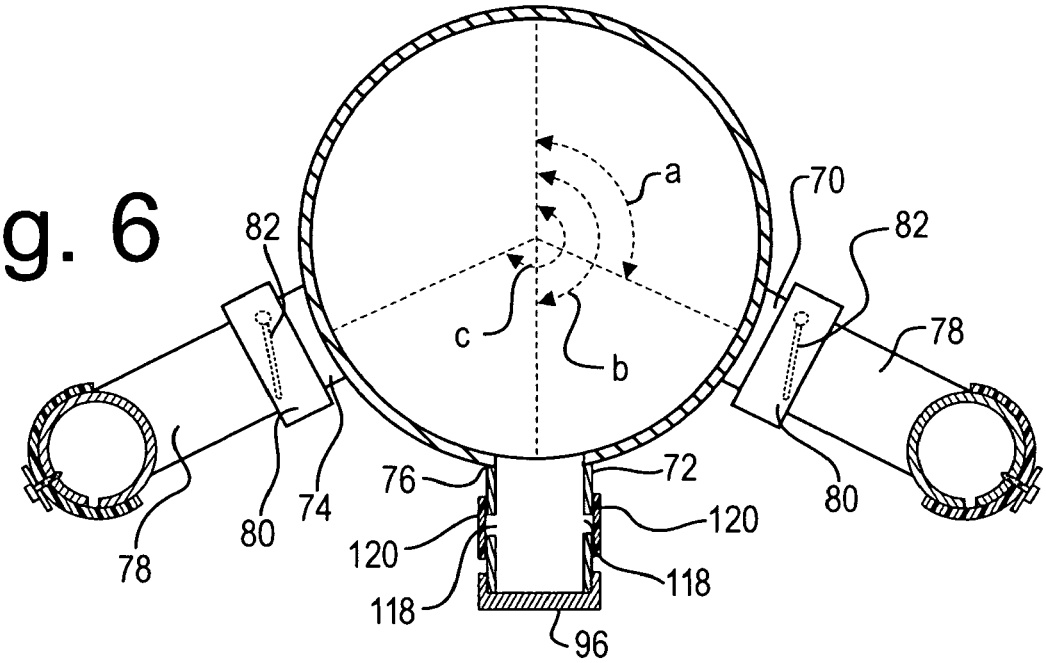

PROCESS AND APPARATUS FOR ENHANCED RECOVERY OF OIL FROM OILY PARTICULATE MATERIAL

FIELD OF THE INVENTION

The invention relates to a process and apparatus for recovering oil from oily sand particles and the like. The apparatus is a vacuum tank and the process utilizes the vacuum tank. The process also comprises using a fatty acid alkyl ester.

BACKGROUND OF THE INVENTION AND PRIOR ART

In the oil industry, heavy oil pumped to the surface contains various components besides the oil itself. Such components include salt water, sand and fine clays. Typically they are pumped into a production tank and a demulsifying chemical is added to aid in the separation of water from the oil. In this separation process, the sand and fine clays settle to the bottom with the sand retaining a residual amount of oil which can vary from about 10% to 40% or more. This mixture of sand and oil is known as oil slop. Water is also bonded to the oil in the slop, thus making the actual volume of sand in the oil slop between about 30% to 50% or less.

Substantial costs are associated with the disposal of oil slop material. Companies are charged a per cubic meter fee for their disposal. The costs are greatly reduced when the oil content of the material is low, since this results in a reduction of the volume of material to be disposed of, in addition to presenting environmental benefits. A variety of processes have been developed to remove oil from the sand.

Currently as a standard procedure in the industry, high pressure water is pumped into the oil slop contained in a production tank servicing the oil well. This process is known as "stinging" the oil well. The water is pumped into the oil slop material through a long wand at a pressure as high as 2500 pounds per square inch. The process makes the oil slop material sufficiently viscous so that it may easily flow from the tank into a vacuum truck. One of two steps is then taken. First, the oil slop material may be taken to a cleaning facility which incorporates heat, mechanical agitation and use of chemicals to separate the oil and water from the sand. This process is quite costly, since it requires not only the initial handling of the material by vacuum trucks but also the disposal of the sand and water after the separation process is completed. This adds significantly to the costs due to additional trucking and infrastructure required to perform the process. Furthermore, the waste sand still must be taken to a disposal site. Even though there is a total reduction in the volume of oil slop material because of the removal of oil and water, the cost savings on disposal do not offset the cost of the cleaning facility plus additional trucking costs incurred according to this process.

More commonly, the oil slop material is taken directly to a disposal cavern where all of the material is disposed of. This results in a complete loss of the oil present in the slop. Even though this procedure results in the complete loss of the oil in the slop, this route is still significantly cheaper than the first route involving the recovery of oil, due to the excessive handling and substantive costs associated with the cleaning facilities and disposing of the sand.

U.S. Pat. Nos. 6,074,549 and 6,527,960, both of Bacon et al., each disclose a process for separating oily films from sand particles. The processes each involve the use of a jet pump scrubber in a density classification tank at temperatures above 65° C.

The prior art also discloses the use of a fatty acid alkyl ester to improve recovery of oil from an oil reservoir. This process is disclosed, for example, in U.S. Pat. No. 6,776,234 of Boudreau and in published Canadian patent application 2,233,710 of Cioletti et al.

SUMMARY OF THE INVENTION

In view of the deficiencies in the prior art, a process is disclosed for treating a mixture of sand, oil and water in the vacuum tank of a vacuum truck. The process allows for recovery of the oil and separation of the water from the sand. The process can occur at the site of the production tank and will thus significantly reduce the cost of trucking because the waste material will only be transported once. If it is not desired to return the mixture of water and oil to the production tank, the mixture can be separated at the site of the production tank. The oil can then be used and the water can be disposed of in a more economical manner than through a cavern. The process also presents environmental benefits because of the extraction of oil that would otherwise end up in the environment.

Furthermore, an apparatus is disclosed for treating a mixture of sand, oil and water in the vacuum tank of a vacuum truck. The apparatus is a vacuum tank into which the mixture of oil, sand and water is transferred from a production tank. The vacuum tank has a series of air pipes along the bottom of the tank for introducing compressed air into the material in the vacuum tank. Furthermore, the air pipes have two types of nozzles through which the compressed air enters the contents of the vacuum tank. Once the compressed air has entered the contents of the vacuum tank, it agitates those contents.

According to a first aspect, the invention relates to a process for recovering oil from an oily particulate material wherein the material is treated with high-pressure water and compressed air in a vacuum tank. A fatty acid alkyl ester may also be added to the material. More specifically, the material is loaded into a vacuum tank, high pressure water is added to the tank and next compressed air is added to the tank. Tank vibrators are then engaged. Finally, a mixture of oil and water is separated from the particulates. A fatty acid alkyl ester may be loaded into the tank at the same time that the oily particulate material is loaded into the vacuum tank.

According to a further aspect, the invention relates to an apparatus for treating oily particulate material. The apparatus has a vacuum tank with a housing and a bottom edge. The tank also has at least one air supply pipe attached to an air source. The at least one air supply pipe extends along the bottom edge of the housing of the vacuum tank. The apparatus also has a means for directing air from the at least one air supply pipe into the tank.

According to a further aspect, the invention relates to a nozzle for directing air from an air supply pipe. The nozzle has an air distribution pipe attached to the air supply pipe and at least one air hole in the air distribution pipe. A pipe band is attached to the air distribution pipe and at least one nozzle flap is pivotably attached to the pipe band such that the at least one nozzle flap overlaps the at least one air hold when air is not being forced through the at least one air hole.

According to a further aspect, the invention relates to a further nozzle for directing air from an air supply pipe. An air distribution pipe is attached to a first end of the air supply pipe. A pipe extension is attached to a second end of the air distribution pipe and a tee attachment is also attached to the pipe extension. At least one pipe attachment is attached to the tee attachment and there is at least one air aperture in each of the at least one pipe attachments. A pipe band is attached to each of the at least one pipe attachments. At least one flap valve is pivotably attached to the pipe band such that the at least one flap valve overlaps the at least one air aperture when air is not being forced through the at least one air hole.

BRIEF DESCRIPTION OF THE DRAWINGS

The invention is best understood from the following detailed description when read in connection with the accompanying drawings showing embodiments of the invention. It is emphasized that, according to common practice, the various features of the drawings are not to scale. On the contrary, the dimensions of the various features are arbitrarily expanded or reduced for clarity. Included in the drawings are the following Figures:

FIG. 5 is a bottom plan view of a portion of an air supply line;

FIG. 6 is a sectional view of the air supply line along line 6-6 of FIG. 5;

Figure 1:
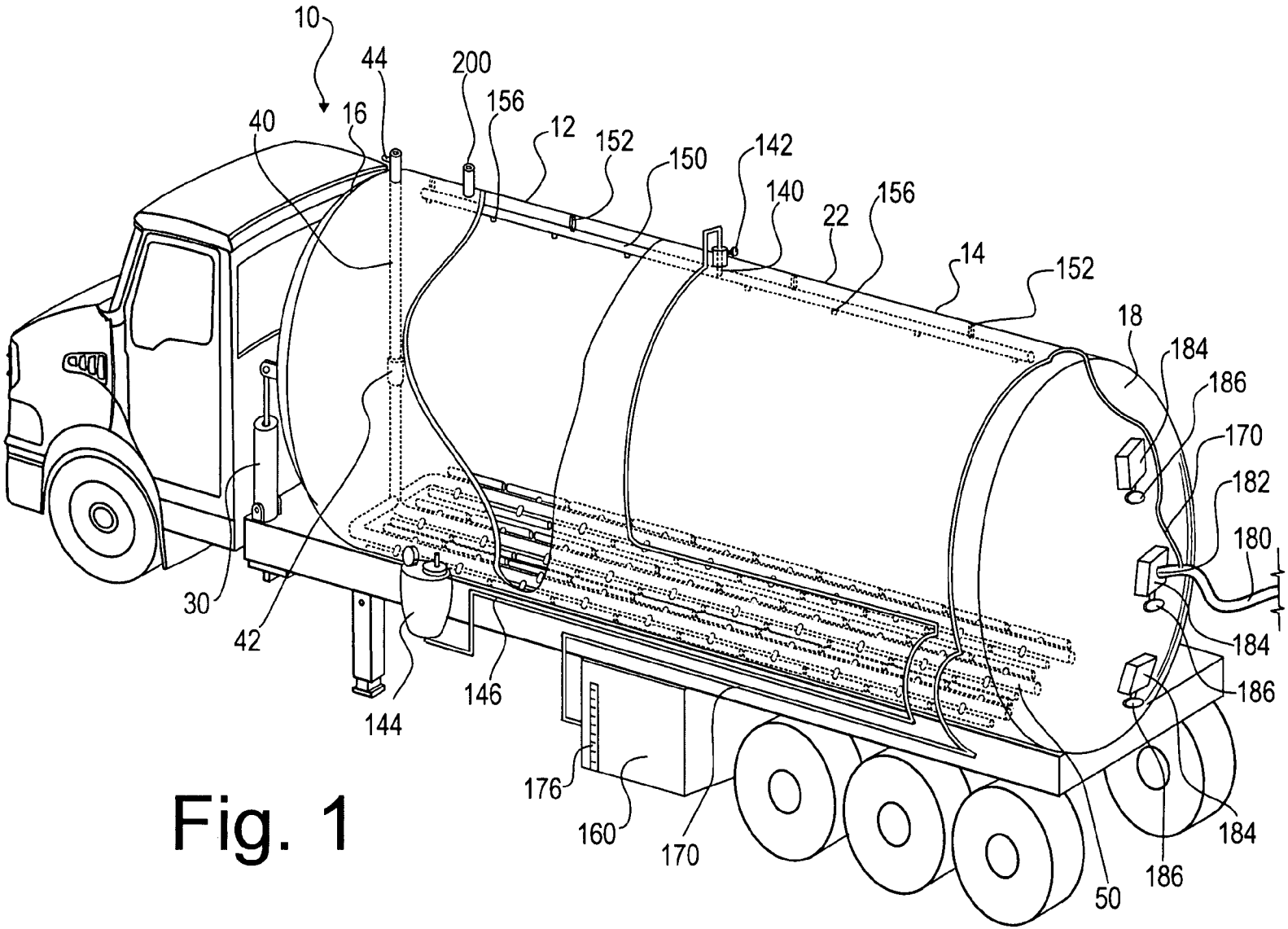
FIG. 1 is a front perspective view of the vacuum tank attached to a truck.

While the invention will be described in conjunction with the illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features have been given similar reference numerals.

Figure 2:
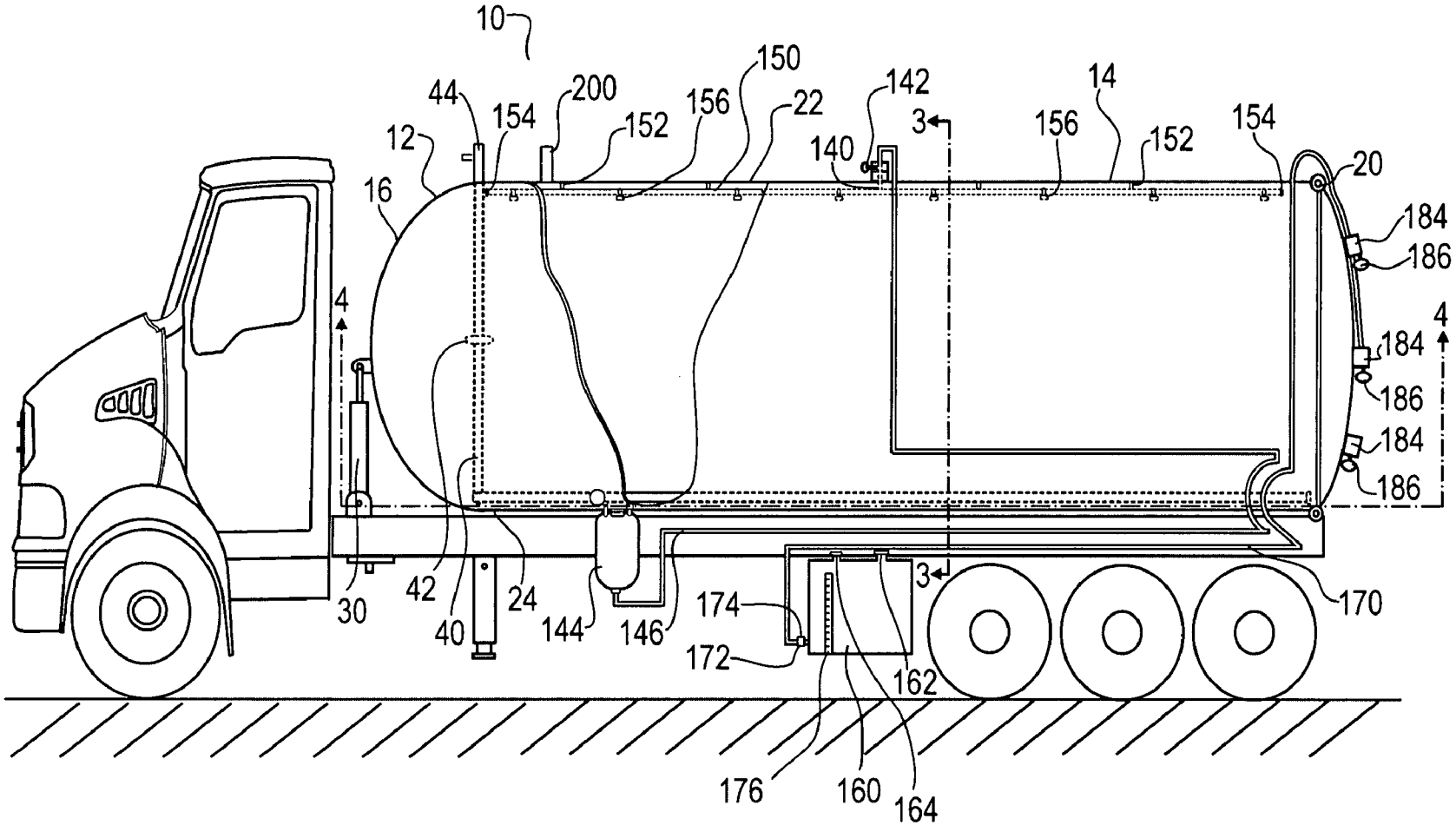
FIG. 2 is a side plan view of the vacuum tank attached to a truck.

A vacuum truck 10 is shown in FIGS. 1 and 2. The vacuum truck 10 has a vacuum tank 12 mounted on it. Though the vacuum tank 12 may be attached to the vacuum truck 10 or another transport vehicle such as a trailer, use of the vacuum tank 12 when it is not attached to a vehicle of any kind is contemplated.

The vacuum tank 12 has a housing 14. The housing 14 is preferably cylindrical in shape with a front wall 16 and an opening at a back end. The vacuum tank 12 has a back door 18 rotatably attached by a top hinge 20 to the vacuum tank 12. The back door 18, when in a closed position, covers the opening at the back end of the vacuum tank 12. The vacuum tank 12 has a top edge 22 and a bottom edge 24. The vacuum tank 12 has a volume of between 26 and 32 cubic meters. The vacuum tank 12 has an anti-wear coating on its inside surface. The coating applied to the inside of the vacuum tank 12 can be any commercially available coating that will prevent abrasion such as Inviroline 115™, Devoe 253™ or Hepel 15500™. The vacuum tank 12 is capable of sucking oil slop material from a source into the vacuum tank 12 when a vacuum pump (now shown) is engaged. In one embodiment of the invention, the vacuum pump has a variable speed compressor (not shown) for altering the rate at which oil slop material is introduced into the vacuum tank 12. Vacuum trucks with such vacuum tanks are well known in the industry for transporting oil slop material.

The vacuum truck 10 has a hydraulic ram 30 attached to the vacuum tank 12 near the front wall 16 for lifting the vacuum tank 12. The vacuum tank 12 is also attached to the vacuum truck 10 at a bottom hinge 32 located near the back door 18 and the bottom edge 24.

Figure 4:
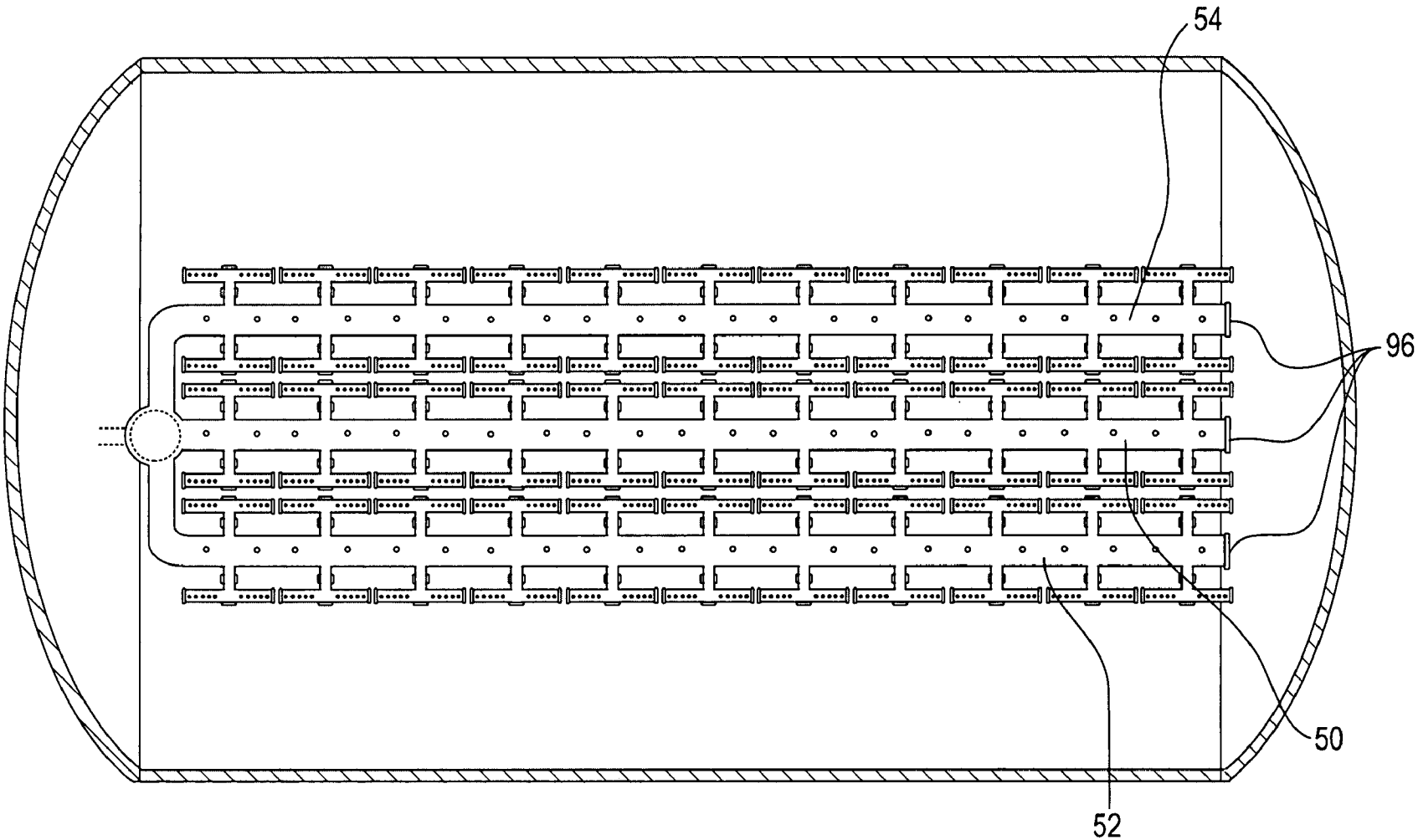
FIG. 4 is a sectional view of the vacuum tank along line 4-4 of FIG. 2.

As shown in FIGS. 1 and 4, the vacuum tank 12 has a series of pipes for distributing air through the contents of the vacuum tank 12. The pipes are constructed of a solid material such as steel or fibreglass. A main air supply inlet 40 is attached to an air source. In one embodiment, the air braking system on the vacuum truck 10 is the air source. The air supply inlet 40 is located near the front wall 16 of the vacuum tank 12 and extends vertically from above the top edge 24 of the vacuum tank 12 to a position near the bottom edge 24 of the vacuum tank 12. The air supply inlet 40 has a diameter of 6 inches. The air supply inlet has an expansion joint 42.

Near the top of air supply inlet 40, there is a water flush pipe 44. The water flush pipe 44 is orientated perpendicularly to the air supply inlet 40. The water flush pipe 44 has a diameter of 1 inch.

Figure 3:
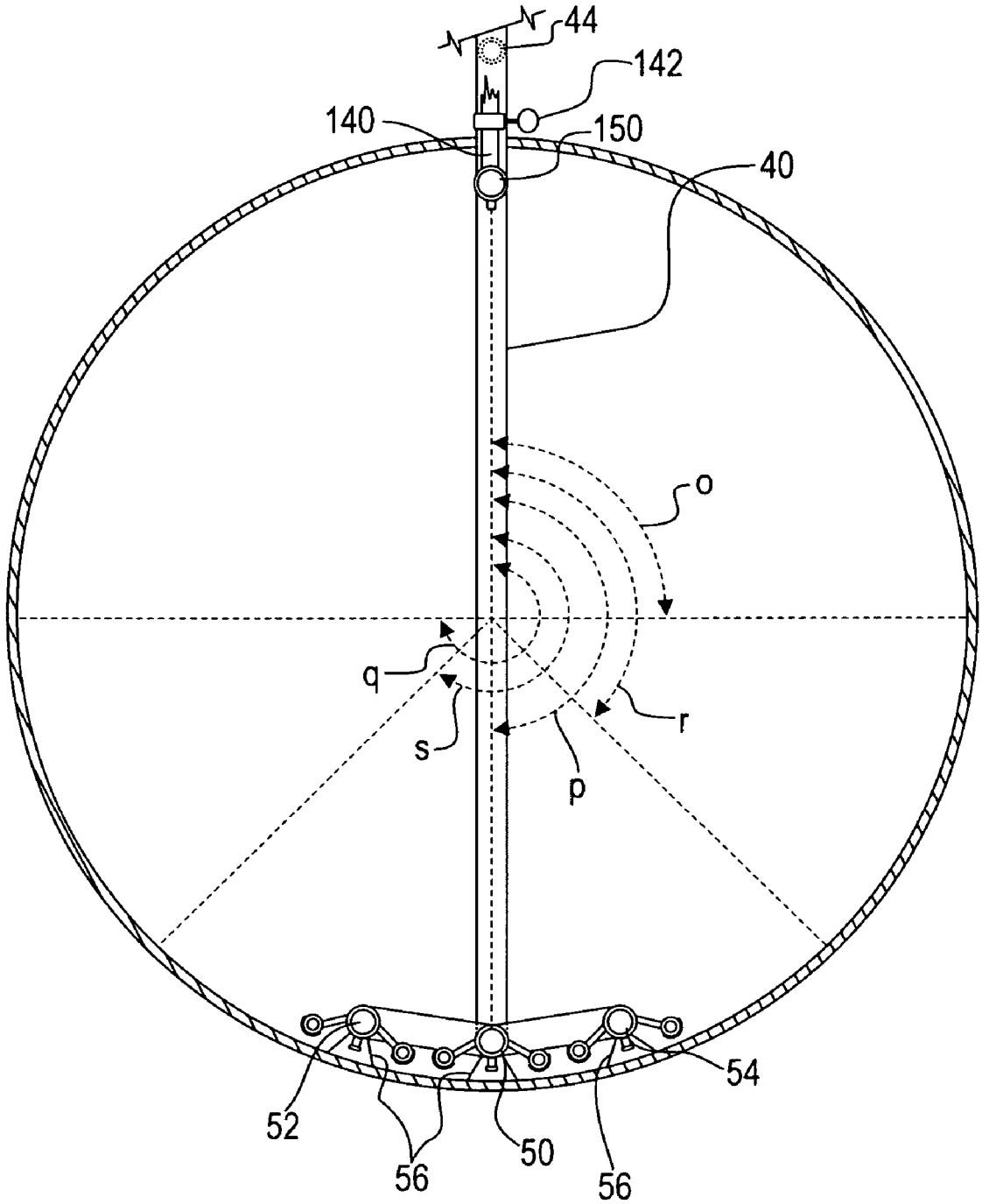
FIG. 3 is a sectional view of the vacuum tank along line 3-3 of FIG. 2.

The air supply inlet 40 is attached near the bottom edge 24 of the vacuum tank 12 to three air supply pipes. One of the air supply pipes is a middle air supply pipe 50. The air supply inlet 40 is also attached to side air supply pipes 52 and 54. Each of the middle air supply pipe 50 and the side air supply pipes 52 and 54 are attached to the air supply inlet 24 by conventional means such as welding. The middle air supply pipe 50 and the side air supply pipes 52 and 54 extend along most of the length of the vacuum tank 12. Furthermore, as seen in FIG. 3, the middle air supply pipe 50 and the side air supply pipes 52 and 54 are each set upon a number of adjustable mounting supports 56. The adjustable mounting supports 56 are attached to the vacuum tank 12 near the bottom edge 24 of the vacuum tank 12. The height of the adjustable mounting supports 56 and the expansion joint 42 on the main air supply inlet 40 may be varied so that the height of the middle air supply pipe 50 and side air supply pipes 52 and 54 may be altered. In one embodiment, the middle air supply pipe 50 and the side air supply pipes 52 and 54 are each constructed of one inch steel pipe and have a diameter of 3 inches. The middle air supply pipe 50 and the side air supply pipes 52 and 54 are cylindrical.

The middle air supply pipe 50 extends along the bottom edge 24 of the vacuum tank 12 slightly above the bottom edge 24 of the vacuum tank 12. Both of the side air pipes 52 and 54 are orientated slightly above the middle air supply pipe 50. The distance between the centre of the middle air supply pipe 50 and the centers of each of the side air supply pipes 52 and 54 is 13 inches.

Each of the middle air supply pipe 50 and the side air supply pipes 52 and 54 have a clean out cap 60. The clean out caps 60 are threaded and are removably attached to ends of the air supply pipes near the back door 18 of the vacuum tank 12.

Further detail of the construction of an embodiment of the middle air supply pipe 50 and the side air supply pipes 52 and 54 is shown in FIGS. 5 and 6. In each of these drawings, a single air supply pipe is depicted and may represent middle air supply pipe 50 or one of side air supply pipes 52 and 54. Each of the air supply pipes has three air distribution pipes 70, 72 and 74. The air distribution pipes 70, 72 and 74 each have a diameter of 1 inch, are cylindrical and in one embodiment are constructed from steel pipe. As seen in FIG. 6, the center of the first air distribution pipe 70 is located at an angle a from the top of the air supply pipe. The angle a is 115 degrees. The center of the air distribution pipe 72 is located at an angle b from the top of the air supply pipe. The angle b is equal to 180 degrees. The center of the third air distribution pipe 42 is located at an angle c from the center of the air supply pipe. The angle c is equal to 245 degrees.

Each of the air distribution pipes 70, 72 and 74 is removably attached to the air supply pipe at one of threaded pipe sockets 76. Furthermore, in one embodiment of the invention, the air distribution pipes 70 and 74, at 115 degrees and 245 degrees, respectively, each have a pipe extension 78 attached to them. In one embodiment, the pipe extensions 78 are cylindrical and constructed from one inch steel pipe. Each of the pipe extensions 78 is attached to its respective air distribution pipe by a threaded attachment 80. Furthermore, at each threaded attachment 80 there is a check valve 82 separating the pipe extension 78 from the air distribution pipe 70 or the air distribution pipe 74. The check valves 82 are each conventional check valves and are well known in the art. The check valves 82 permit the flow of air from one of the air distribution pipes to its respective pipe extension 78.

Each of the pipe extensions 78 has a threaded tee attachment 90 removably attached to it. Two pipe attachments 92 and 94 are removably attached to the threaded tee attachment 90. The pipe attachments 92 and 94 are each approximately 16 inches long and in one embodiment extend parallel to the middle air supply pipe 50 and the side air supply pipes 52 and 54. The pipe attachments 92 and 94 are each cylindrical and in one embodiment are constructed from one inch thick steel pipe. The total length of the assembly of the threaded pipe tee attachment 90 and the pipe attachments 92 and 94 is 36 inches. The pipe attachments 92 and 94 are threaded at both ends and each have a pipe cap 96 attached to an end that that is not attached to the threaded tee attachment 90. Furthermore, each of the pipe attachments 92 and 94 have a series of air discharge apertures 98 spaced evenly apart along their respective lengths. In one embodiment of the invention, there are 15 apertures 98 on each of the pipe attachments 92 and 94. The apertures 98 are located on the underside of the pipe attachments 92 and 94. Furthermore, each aperture 98 is circular and ⅛ of an inch in diameter.

Figure 7:
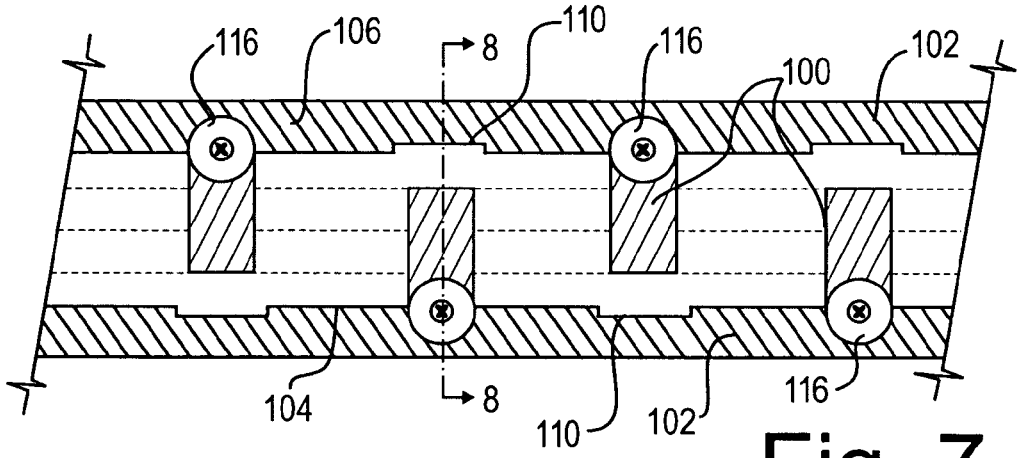
FIG. 7 is a bottom plan view of a portion of a pipe attachment.

FIG. 7 depicts a further embodiment of a pipe attachment. The pipe attachment shown in FIG. 7 may be pipe attachment 92 or pipe attachment 94. As seen in FIG. 7, series of flap valves 100 covers apertures 98. Each flap valve 100 covers an aperture 98. The flap valves 100 are constructed from a flexible material such as rubber or plastic and are curved to follow the curvature of the pipe attachments 92 and 94. Each flap valve 100 is ⅞ of an inch long, ⅝ of one inch wide and ¼ inch thick. Each flap valve 100 extends from a first pipe band 102 and is pivotably attached to the first pipe band 102. The first pipe band 102 is constructed from the same material from which the flap valves 100 are constructed and is thus one inch thick. The flap valves 100 are each desirably integrally attached to the first pipe band 102. The first pipe band 102 is rectangular and has a first elongate edge 104 and a second elongate edge 106. The first pipe band 102 extends along the entire length or most of the length of each of the pipe attachments 92 and 94. Every second aperture 98 in the pipe attachments 92 and 94 is covered by a flap valve 100 extending from the first elongate edge 104 of the first pipe band 102. The other apertures 98 in the pipe attachments 92 and 94 are covered by a flap valve 100 extending from the second elongate edge 106 such that the apertures 98 are covered by flap valves 100 extending from alternating edges of the first pipe band 102.

On the first elongate edge 104 of the first pipe band 102 there is a series of notches 110 such that one of the notches 110 is opposite to where each flap valve 100 extends from the second elongate edge 106. Similarly, on the second elongate edge 106 of the first pipe band 102 there is a series of notches 110 such that one of the notches 110 is opposite to where each flap valve 100 extends from the first elongate edge 104. Each of the notches 110 is one inch long and ¼ of an inch wide.

The first pipe band 102 is attached to each of the pipe attachments 92 and 94 by a series of screw and washer assemblies 116. The screw and washer assemblies 116 are each orientated at the attachment of the flap valve 100 to the first pipe band 102 at half of the width of the flap valve 100. Each screw and washer assembly 116 may be tightened or loosened so as to alter the amount that the flap valve 100 will pivot about its attachment to first pipe band 102. This alters the pressure resistance of the flap valve 100. Each screw and washer assembly 116 is aligned with one of the apertures 98 and a point halfway along the length of one of the notches 110.

Figure 8:
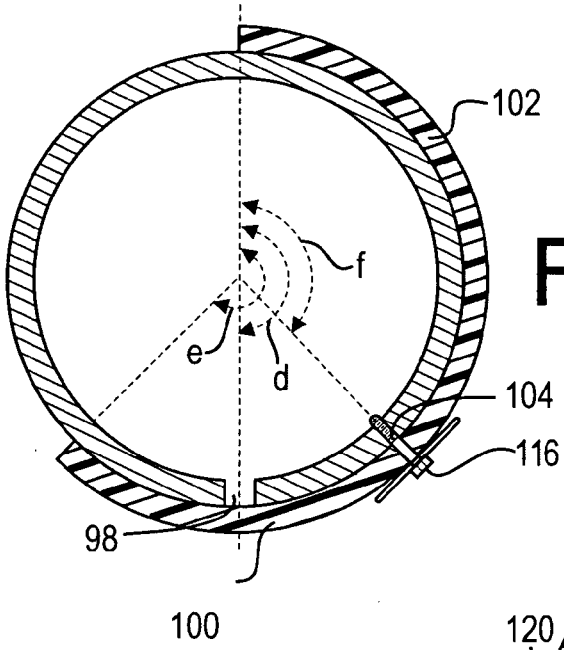
FIG. 8 is a sectional view of the pipe attachment along line 8-8 of FIG. 7.

As shown in FIG. 8, each aperture 98 is at an angle d from the top of the pipe attachments 92 and 94. The angle d is equal to 180 degrees. Each flap valve 100 extending from the first elongate edge 104 of the first pipe band 102 will extend to a point at an angle e from the top of one of air distribution pipes 92 and 94. The angle e is equal to 220 degrees. Each screw and washer assembly 116 attaching the first pipe band 102 to the pipe attachment 92 or the pipe attachment 94 near the first elongate edge 104 of the first pipe band 102 is attached at an angle f from the top of one of air distribution pipes 92 and 94. The angle f is equal to 135 degrees. Similarly, each flap valve 100 extending from the second elongate edge 106 of the first pipe band 102 will extend to a point at an angle g (not shown) from the top of one of air distribution pipes 92 and 94. The angle g is equal to 140 degrees. Each screw and washer assembly 116 attaching the first pipe band 102 to the pipe attachment 92 or the pipe attachment 94 near the second elongate edge 106 of the first pipe band 102 is attached at an angle h (not shown) from the top of one of air distribution pipes 92 and 94. The angle h is equal to 225 degrees.

Figure 9:
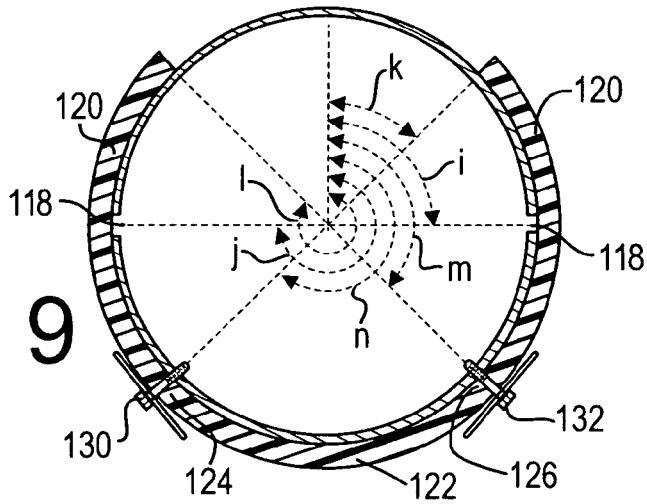
FIG. 9 is a sectional view of an air distribution pipe.

As seen in FIGS. 6 and 9, in one embodiment of the invention, a nozzle on the air distribution pipe 72 does not have a pipe extension or a check valve. Rather, the air distribution pipe 72 has a pipe cap 96 removably attached to an end of the air distribution pipe 72 opposite to the end of the air distribution pipe 72 at which the air distribution pipe 72 is attached to the middle air supply pipe 50. The length of the air distribution pipe 72 is one and one half inches. The air distribution pipe 72 has two air holes 118. The air distribution pipe 72, the pipe cap 96 attached to the air distribution pipe 72 and the air holes 118 comprise an air nozzle for forcing air into the vacuum tank 12. Each of the air holes 118 is circular and has a diameter of ⅛ of an inch. The air holes 118 are located along the length of the air distribution pipe 72 as close as possible to the pipe cap 96 without being obstructed by the pipe cap 96. The two air holes 118 on the air distribution pipe 72 are located at angles i and j on the air distribution pipe 72. Angle i is equal to 90 degrees and angle j is equal to 270 degrees.

Each of the air holes 118 on the air distribution pipe 72 is covered by a nozzle flap 120. The nozzle flaps 120 are constructed from a flexible material such as rubber or plastic and are curved to follow the curvature of the air distribution pipe 72. Each nozzle flap 120 has a length of ⅞ of an inch, a width of ⅝ of an inch and is ¼ inch thick. Each nozzle flap 120 is attached to a second pipe band 122 and is pivotably attached to second pipe band 122. The second pipe band 122 is rectangular extends along the entire length of the air distribution pipe 72 or along most of the length of the air distribution pipe 72. The second pipe band 122 is desirably constructed from the same material from which nozzle flaps 120 are constructed and is thus ¼ inch thick. The nozzle flaps 120 are each desirably integrally attached to the second pipe band 122. The second pipe band 122 has a first elongate side 124 and a second elongate side 126. A single nozzle flap 120 extends from each of the first elongate side 124 and the second elongate side 126 of the second pipe band 122.

The second pipe band 122 is attached to the air distribution pipe 72 by two screw and washer attachments 130 and 132. The screw and washer attachments 130 and 132 are each orientated at the attachment of one of the nozzle flaps 120 to the distribution pipe 72. The screw and washer attachments 130 and 132 are aligned with the air holes 118 and a point halfway along the width of the nozzle flaps 120. The screw and washer attachments 130 and 132 may be tightened or loosened so as to alter the amount that the nozzle flaps 120 will pivot about their attachment to second pipe band 122.

As shown in FIG. 9, the two nozzle flaps 120 extend to angles of k and l, respectively, around the distribution pipe 72. The angle k is equal to 50 degrees and the angle l is equal to 310 degrees. The screw and washer attachments are attached to the air distribution pipe 72 and angles m and n. The angle m is equal to 135 degrees and the angle n is equal to 225 degrees.

There are a number of air distribution pipes 72 without pipe extensions 78, threaded tee attachments 90 or pipe attachments 92 and 94 along the lengths of each of the middle air supply pipe 50 and along the length of each side air supply pipe 52 and 54. Such air distribution pipes are spaced 6 inches apart. Furthermore, as shown in FIG. 4, in another embodiment, there are a number of air distribution pipes 70 and 74 each having pipe extensions 78, threaded tee attachments 90 and pipe attachments 92 and 94 along the length of the middle air supply pipe 50 and along the length of each side air supply pipe 52 and 54. The pipe attachment 92 from one pipe extension is half of one inch from the pipe attachment 94 of a second pipe extension. In a further embodiment (not shown), air distribution pipes 70 and 74 have no pipe extensions 78, threaded tee attachments 90 or pipe attachments 92 and 94 and instead have nozzles constructed as described above regarding air distribution pipe 72.

Because of the curvature of the vacuum tank 12, the attachments to the side air supply pipes 52 and 54 will be slightly inclined. More specifically, as shown in FIG. 3, the pipe attachments 92 and 94 along the sides of the side air supply pipes 52 and 54 away from the middle air supply pipe 50 will be orientated slightly above the pipe attachments 92 and 94 along the sides of the side air supply pipes 92 and 94 closer to the middle air supply pipe 50.

As seen in FIGS. 1 and 2, the vacuum tank 12 also has a chemical inlet 140. The chemical inlet 140 is located halfway along the length of the vacuum tank 12 at the top edge 22 of the vacuum tank 12. The chemical inlet 140 has an air shut off valve 142. The chemical inlet 140 is attached to a pressurized chemical tank 144 by chemical supply line 146. The chemical tank 144 is attached to the vacuum truck 10 or the vehicle to which the vacuum tank 12 is attached, such as a trailer. Alternatively, the chemical tank 144 may be attached to the vacuum tank 12 directly or only attached to the vacuum tank 12 by chemical supply line 146. The chemical tank 144 receives pressured air from an air supply source such as the air braking system of the vacuum truck 10.

The chemical inlet 110 attaches to a chemical distribution line 150. The distribution line 150 is suspended within the vacuum tank 12 near the top edge 22 of the vacuum tank 12. A series of distribution line supports 152 suspends the distribution line 150 approximately 1 inch from the top edge 22 of the vacuum tank 12. The chemical distribution line 150 is approximately 30 feet in length and has a one half inch diameter. Desirably, the chemical distribution line 150 is constructed of a number of lengths of commercially available thread assembled piping. A chemical line end cap 154 is removably attached to each end of the distribution line 150. A number of distribution nozzles 156 are located along the length of the distribution line 150. The distribution nozzles 156 are generally orientated downward. In one embodiment of the invention, distribution nozzles 156 are conventional pressure atomized nozzles.

The vacuum tank 12 is equipped with a standard vibration system (not shown). The vibration system consists of a number of series of vibrators located along the length of the vacuum tank 12. In one embodiment, there are three series of five vibrators evenly spaced along the length of the vacuum tank 12. As seen in FIG. 3, these three series of vibrators are located evenly apart in parallel lines along the length of the vacuum tank 12 at angles of o, p and q, respectively, from the top of the vacuum tank 12. The angle o is equal to 90 degrees, the angle p is equal to 180 degrees and the angle q is equal to 270 degrees. The vacuum tank 12 also has two series of four vibrators located evenly along the length of the vacuum tank 10. These two series of vibrators are located evenly in parallel lines along the length of the vacuum tank 12 at angles of r and s respectively. The angle r is equal to 135 degrees from the top of the vacuum tank 12 and the angle s is equal to 225 degrees from the top of the vacuum tank 12. Each series of vibrators may be engaged separately from the other series of vibrators. The number of vibrators may be less than described herein and should not cause vibrational stress upon the vacuum tank 12.

As shown in FIGS. 1 and 2, the vehicle carrying the vacuum tank 12 will also be equipped with a metering tank 160. The metering tank 160 is attached by conventional means to the vacuum truck 10. Alternatively, the metering tank 160 is attached to a trailer for hauling the vacuum tank 12 or directly to the vacuum tank 12. The metering tank 160 has a volume between 160 litres and 240 litres. The metering tank 160 has a metering tank addition point 162. In a preferred embodiment, the metering tank addition point 162 has a vented cap for covering the addition point 162. The metering tank 160 also has a metering tank vent 164.

A supply line 170 is attached to the metering tank 160, preferably near the bottom of the metering tank 160. The supply line 170 has a shut off valve 172 and a needle valve 174. Furthermore, the metering tank 160 has a graduated measurement sight glass 176. The supply line 170 leads from the metering tank 160 to a vacuum tank load line 180. The supply line 170 attaches to the vacuum tank load line 180 at load line addition point 182. The load line 180 leads into the vacuum tank 12 through an entry point 184 on the back door 18 of the vacuum tank 12.

The vehicle carrying the vacuum tank 12 has one or more entry points 184. The entry points 184 are located on the back door 18. In one embodiment, each of the entry points 184 are located at a different height on the back door 18. The entry points 184 facilitate hose connections for loading fluids or other materials into the vacuum tank 12. The entry points also allow for unloading of materials from vacuum tank 12. If the entry points 184 are located at different heights, materials located at different levels in the vacuum tank 12 may be removed from the vacuum tank 12 separately. Each of the entry points 184 has a shut off valve 186.

A water load line 190 is attached to one of the entry points 184 the vacuum tank 12 through a water load line attachment 192. The water load line 190 has a diameter of four inches.

The vacuum tank 12 also has an air outlet 200. Air outlet 200 is a conventional feature in vacuum tanks and is used to regulate pressure within the vacuum tank 12.

Finally, the vacuum tank 12 may have one or more air shut off valves 206 attached to the back door 18.

In operation, oil slop material is sucked from a production tank (not shown) into the vacuum tank 12 through vacuum tank load line 180. The oil slop material flows easily from the production tank to the vacuum tank 12 because of the enhanced viscosity of the oil slop material resulting from the prior art process of applying high pressure water to the oil slop material while it is in the production tank.

While the oil slop material is being loaded into the vacuum tank 12, a fatty acid alkyl ester may be introduced into the oil slop material from the metering tank 160 through supply line 170 at load line addition point 182. The alkyl ester may be introduced at a rate of about four litres per cubic meter of oil slop material so that the alkyl ester is added evenly to the oil slop material. Alternatively, the alkyl ester may be introduced after the oil slop material has been loaded into the vacuum tank 12 and before the oil slop material is processed.

Fatty acid alkyl esters suitable for use in the process of the invention are well known in the art and described for example a U.S. Pat. No. 6,776,234 (Boudreau). Preferred fatty acid alkyl esters include long chain fatty acid methyl or ethyl esters, generally represented by the chemical formula $RCOOCH_3$ or $RCOOCH_2CH_3$, wherein the R group contains between 4 to 40 carbon atoms. The R group may be saturated or unsaturated and may contain one or more double bonds. Such ester is obtained by a trans-esterfication reaction between a triglyceride and methanol or ethanol in the presence of a suitable base catalyst such as sodium or potassium hydroxide. The triglyceride may include triglycerides present in natural oils of plants or animals such as canola oil. More preferred fatty acid alkyl esters are fatty acid methyl esters, commonly known as biodiesel.

The alkyl ester reduces the surface tension of the oil within the oil slop material and increases the lubricity of the oil, causing the oil within the oil slop material to mix more readily with the water in the oil slop material. This reduces the specific gravity of the oil within the oil slop material such that the oil migrates upward in the mixture.

Once the necessary volume of oil slop material to be treated has been loaded into the vacuum tank 10, high pressure salt water is added to the contents of the vacuum tank 12 through water load line 190. The amount of salt water added to oil slop material can vary from about 60 percent to 120 percent of the volume of oil slop material contained in the vacuum tank 12. The amount of salt water is dependent upon the concentration of the oil in the oil slop material. If the oil slop material has a lower concentration of oil, such as 10 percent to 20 percent concentration of oil by volume, the amount of water of added would be only 60 percent of the volume of oil slop material in the vacuum tank 10. Conversely, if there is a 20 percent to 40 percent concentration of oil in the oil slop material, the volume of salt water added would be equal to the volume of the oil slop material in the vacuum tank 12. The volume of salt water added must be sufficient so that a layer of salt water is maintained in the vacuum tank 12 during the next step of the procedure when the mixture is agitated by the injection of air. An insufficient volume of water will merely result in a uniform mixture of slop, water and oil in a foam suspension.

After water has been added to the vacuum tank 12, the vacuum pressure inside the vacuum tank 12 is reduced to atmospheric pressure and the tank is inclined slightly. Compressed air is directed through the air supply inlet 40 from the air source. The air is forced through the air supply inlet 40 and into middle air supply pipe 50 and side air supply pipes 52 and 54. The compressed air then travels through air distribution pipes 70, 72 and 74. The air escapes from air distribution pipes 72 and into the oil slop material/water/alkyl ester mixture by forcing nozzle flaps 120 away from air holes 118. The air escaping from nozzle holes 118 is initially projected toward distribution pipe 70 from one side of distribution pipe 72 and toward distribution pipe 74 from the opposite side of distribution pipe 72 such that the path of the air in the oil slop material is not obstructed by middle air supply pipe 50 or side air supply pipes 52 and 54. From the air distribution pipes 70 and 74, the compressed air travels through the pipe extension 78 and into pipe attachments 92 and 94 through the check valves 82. The compressed air then enters the mixture by forcing the flap valves 100 away from air apertures 98. The air from apertures 98 is initially projected downward.

When air is not being forced into the mixture, flap valves 100 are contiguous to pipe attachments 92 and 94 and nozzle flaps 120 are contiguous to air distribution pipe 72 to obstruct sand from the mixture from entering the air supply system. If sand or other foreign substances enter the air supply system, cleanout caps 60 may be removed to permit cleaning of the middle of air supply pipe 50 and the side air supply pipes 52 and 54. Furthermore, the pipe caps 96 may be removed to permit cleaning of the pipe attachments 92 and 94.

Upon being forced through the air apertures 98 and the air holes 118, the compressed air rises through the mixture to agitate and scour the sand suspended within the mixture. Sand that was mixed with the oil is separated from the oil. The compressed air also raises the oil within the mixture through the mixture such that an oil foam layer is formed near the top of the vacuum tank 12. The oil foam layer will contain oil, a water emulsion formed of water bonded to oil, light clay ends, trace amounts of sands and the alkyl ester blended with the oil. There will essentially be no free water in the oil foam layer.

The compressed air does not have to be added to the vacuum tank 12 at an overly high pressure. A pressure of approximately 15 to 30 pounds per square inch may be sufficient. However, a relatively large volume of compressed air may be required to thoroughly agitate the mixture. The volume of compressed air may be in the range of about 900 to 1600 cubic feet per minute for between 10 and 30 minutes. The volume of cubic feet per minute of air may vary depending upon the original oil concentration in the oil slop material and the total volume of oil slop material to be processed.

After the oil slop material and water mixture is agitated, the vibration system is activated. The resulting vibration of the vacuum tank 12 aids the process of the separation of sand and clay from the oil foam layer near the top of the vacuum tank 12 and compacts the sand at the bottom of the vacuum tank 12. The vibration system is activated for between 10 and 30 minutes.

After the tank vibrators are activated, the mixture is left to settle and separate for about 15 to 30 minutes. An anti-foam agent may then be sprayed onto to the top of the oil foam layer through chemical distribution nozzles 156. Commercially available anti-foam agents such as Nalco Canada EC6416A™ antifoam, antifoam agents produced by Baker Chemical™ or Champion Chemicals™ or any suitable anti-foam agent may be used. Between one and two litres of anti-foam agent may be required, depending on the concentration of oil in the original oil slop material. The anti-foam agent removes excess oxygen from the oil foam layer so as to prevent the excessive expansion of the oil foam layer.

Between one and two litres of anti-foam agent will be required for every 5 cubic metres of oil retrieved from the process.

After addition of the anti-foam agent, or after the mixture settles and separates if no anti-foam agent is employed, a commercial demulsifier may be sprayed onto the oil foam layer through chemical distribution nozzles 156. The demulsifier should be added at a high pressure through the distribution nozzles 156 so that it is misted upon the oil foam layer. A commercially available demulsifier such as now Nalco Canada EC 2247A™ may be used. About one litre of demulsifier will be required for every ten thousand litres of oil slop material processed. The demulsifier strips water and clays from the oil foam layer so that they settle from the oil foam layer, thus further separating the components of the mixture. Between one and two litres of demulsifier will be required for every 5 cubic metres of oil retrieved from the process.

After the demulsifier has been added, air pressure within the vacuum tank 12 is decreased to approximately minus 26 inches of mercury. The increase in vacuum pressure causes the majority of larger air bubbles in the oil foam layer to burst. This reduces the amount of entrained oxygen in the oil foam layer and thus limits the oxygen that is re-introduced from the vacuum tank 12 to the production tank later in the process. This step may not be necessary if the oil from the mixture is being returned to a tank in which there is no flammable oil.

After approximately five minutes of application of the increased pressure within the vacuum tank 12, the majority of the entrained oxygen will be removed and the oil foam layer has become an oil emulsion layer. The oil emulsion layer is orientated above a water layer in the vacuum tank 12. By this stage in the process, sand and clay has settled to the bottom of the vacuum tank 12.

The vacuum tank 12 is then inclined to an approximate angle of 15 degrees from level by engaging the hydraulic ram 30. Excess air is removed from the vacuum tank 12. Gases present in the vacuum tank are blown out of air outlet 200. The oil emulsion layer is then removed from the vacuum tank 12 and returned to the oil production tank through the vacuum tank load line 180. The oil emulsion layer is forced from the oil production tank by increasing pressure in the vacuum tank 12 so as to force the oil emulsion layer from the vacuum tank 12. Once the oil emulsion layer is removed from the vacuum tank 12, the vacuum tank 12 is further inclined and the water layer is removed into the production tank through the vacuum tank load line 180. Some clay particulates may be in the water layer at this stage. The water layer is also removed by the increased pressure in the vacuum tank 12.

Alternatively, before unloading the oil emulsion layer and water from the vacuum tank 12, a second load of oil slop material to which alkyl ester has been added may be added to the vacuum tank 12. The layer of sand that has precipitated from the first load of oil slop material is agitated by activating the air source to introduce the sand into the second load of oil slop material. Further water and compressed air are added to the mixture. The balance of the process, namely vibration of the oil slop material/water/alkyl ester mixture, settlement and separation of sand and clay, possible addition of the anti-foam agent, addition of the demulsifier, increase of pressure and pressurization may then occur before the processed material is returned to the production tank.

If the process is conducted upon two loads of oil slop material before returning the processed material to the production tank, the vacuum tank 12 will have a larger volume than conventional vacuum tanks. This does not present a risk of overloading the vacuum tank 12 for transport since only the sand and clay precipitate is transported. There will simply be a greater volume of sand and clay to dispose of. This will result in greater efficiencies in time, especially when the oil production tank is located far from a sand and clay disposal facility. The process may be conducted on more than two loads of oil slop material if the remaining volume of sand is small.

Once the oil emulsion layer and the water have been returned to the production tank, a precipitate comprised mostly of sand is left in the vacuum tank 12. The volume of precipitate depends upon a number of factors such as the original concentration of the oil slop material and whether more than one load of slop material have been processed before removal of the precipitate. The precipitate will also contain clay, salt water and trace amounts of oil. The sand precipitate can then be removed from the vacuum tank 12 by opening the back door 18, engaging the hydraulic ram 30 and inclining the vacuum tank 12. The tank vibrators may be activated to help remove the sand precipitate from the vacuum tank 12. The sand precipitate may then be disposed of at a sand disposal facility. The vacuum tank 12 may then be cleaned by use of conventional means such as high pressure water cannons that are available at sand disposal facilities.

Within the production tank, the oil emulsion layer combines with an oil column situate within the production tank. A further demulsifier is then added to the production tank to separate the oil emulsion layer, water, trace amounts of sand and fine clays suspended in the water. The water may be removed by heating the contents of the production tank. Traces of acid alkyl ester added to the oil slop mixture remain in the water and accelerate the process of removing the water.

After the contents of the production tank have been heated, the oil retrieved from the process may be used commercially. Alternatively, the oil may be reloaded into the vacuum tank 12 for re-processing. Specifically, the oil may be subjected to the process described above so as to further purify the oil.

To prevent the accumulation of fine clays in the production tank, every third or fourth load from a particular production tank should be returned to a separate production tank.

EXAMPLES

Bench testing has been conducted using four litres of methyl ester per cubic meter of oil slop material on a 12 litre sample oil slop material with 8 litres of water. The oil concentration of the slop material was 35 percent by volume, sand content was 38 percent by volume, clay was present in the amount of 0.5 percent by volume and the remainder of the mixture was water. Agitation was conducted with compressed air at approximately 5 pounds per square inch through 12 one millimeter diameter injection points. The temperature of the sample was 12 degrees Celsius. The mixture was agitated for 10 minutes and the mixture was allowed to settle for 15 minutes after agitation. The resulting emulsion layer had a 50 percent oil concentration by volume, 2 percent sand and fine clay and water in emulsion suspension. The sand layer at the bottom of the tank contained about 1 percent of oil. The method used to determine the oil content of the sand at the bottom of the tank involved use VARSOL™ as a thinning agent and a centrifuge for separation of layers. This process is quite effective but lacks some accuracy in testing for fine trace amounts of oil. The sand layer contained no visible traces of oil and was highly compacted. The water layer was clearly defined above the sand layer. The volume of the processed material had increased 10 percent in comparison with the oil slop material added due to the foaming effect of the oil foam layer.

Numerous additional tests were run on different samples with oil concentration ranging from about 5 percent by volume to 45 percent by volume. The results in all cases were very similar to the results outlined above.

Thus, it is apparent that there has been provided in accordance with the invention an improved and efficient apparatus and process for the recovery of oil from sand particles. The apparatus and the process allow for saving of cost in the waste disposal process for the oil industry and also present advantages on the environment. While the invention has been described in conjunction with specific embodiments thereof, it is evident that many alternative modifications and variations will be apparent to those skilled in the art in light of the foregoing description. Accordingly, it is intended to embrace all such alternatives, modifications and variations as fall within the spirit and broad scope of the invention.

The invention claimed is:

1. A process for recovering oil from an oily particulate material comprising steps of:

(a) providing a transport vehicle having a vacuum tank;

(b) loading the oily particulate material into the vacuum tank;

(c) adding a fatty acid alkyl ester to the oily particulate material;

(d) treating the material with high-pressure water and compressed air in the vacuum tank.

2. A process for recovering oil from an oily particulate material comprising the steps of:

(a) providing a transport vehicle having a vacuum tank;

(b) loading the oily particulate material into the vacuum tank;

(c) adding a fatty acid alkyl ester to the oily particulate material;

(d) loading high-pressure water into the tank;

(e) loading compressed air into the tank;

(f) engaging tank vibrators; and (g) separating a mixture of oil and water from the particulates.

3. A process according to claim 1 or 2, wherein the fatty acid alkyl ester is loaded into the tank at the same time that the oily particulate material is loaded into the tank.

4. A process according to claim 1 or 3, wherein the fatty acid alkyl ester is a fatty acid methyl ester.

5. A process according to claim 3, wherein the fatty acid alkyl ester is loaded at a rate of about four litres per cubic meter of the oily particulate material.

6. A process according to claim 1, 2 or 3, wherein the oily particulate material is a mixture of oil, sand/clay and water from a production well.

7. A process according to claim 1, 2 or 3, wherein water is used in an amount of about 60 percent to 120 percent of the volume of the oily particulate material.

8. A process according to claim 1, 2 or 3, wherein pressure of the air is about 15 to 30 pounds per square inch.

9. A process according to claim 2 further comprising a step of removing excess of air from the tank after step (f).

10. A process according to claim 2 further comprising a step of separating the mixture of oil and water.

11. A process according to claim 1 further comprising using an antifoam agent and/or a demulsifying agent

12. A process according to claim 2 further comprising a step of spraying an antifoam agent and/or a demulsifying agent onto the mixture after step (f).

13. A process according to claim 11 or 12 wherein the antifoam agent is used in an amount of about one to two litres per five cubic meters of oil retrieved from the process.

14. A process according to claim 11 or 12 wherein the demulsifying agent is used in an amount of about one to two litres per 5 cubic metres of oil retrieved from the process.

15. A process according to claim 2, wherein step (f) lasts for about 10 to 30 minutes.

16. A process according to claim 2, wherein step (g) lasts for about 15 to 30 minutes.

* * * * *

UNITED STATES PATENT AND TRADEMARK OFFICE

CERTIFICATE OF CORRECTION

PATENT NO. : 7,588,682 B2
APPLICATION NO. : 11/243367
DATED : September 15, 2009
INVENTOR(S) : Kevin Norman It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 899 days.

Signed and Sealed this

Twenty-first Day of September, 2010

David J. Kappos

David J. Kappos
*Director of the United States Patent and Trademark Office*